US007690707B2

(12) United States Patent
Stinis et al.

(10) Patent No.: US 7,690,707 B2
(45) Date of Patent: Apr. 6, 2010

(54) HOISTING FRAME AND METHOD FOR ITS USE

(75) Inventors: Cornelis Stinis, Krimpen aan de Lek (NL); Karel Frederik Drenth, Gouda (NL); Cornelis Joannes Rijsenbrij, Boskoop (NL); Jeroen Cornelis Bruijn, Delf (NL)

(73) Assignee: Stinis Beheer B.V., Krimpen aan de lek (NL)

( * ) Notice: Subject to any disclaimer, the term of this patent is extended or adjusted under 35 U.S.C. 154(b) by 166 days.

(21) Appl. No.: 10/517,429

(22) PCT Filed: Jun. 5, 2003

(86) PCT No.: PCT/EP03/06032

§ 371 (c)(1),
(2), (4) Date: Jul. 5, 2005

(87) PCT Pub. No.: WO03/104132

PCT Pub. Date: Dec. 18, 2003

(65) Prior Publication Data

US 2006/0043748 A1 Mar. 2, 2006

(30) Foreign Application Priority Data

| | | |
|---|---|---|
| Jun. 10, 2002 | (NL) | 1020822 |
| Apr. 8, 2003 | (NL) | 1023124 |
| May 2, 2003 | (NL) | 1023337 |

(51) Int. Cl.
*B66C 1/10* (2006.01)
*B66C 1/66* (2006.01)

(52) U.S. Cl. ..... 294/81.2; 294/81.1; 294/81.53

(58) Field of Classification Search ..... 294/81, 294/81.2, 81.21, 81.51, 81.53, 81.1
See application file for complete search history.

(56) References Cited

U.S. PATENT DOCUMENTS

| | | | | |
|---|---|---|---|---|
| 3,671,069 | A * | 6/1972 | Martin et al. | 294/81.1 |
| 3,709,543 | A * | 1/1973 | Tax et al. | 294/81.2 |
| 3,980,185 | A * | 9/1976 | Cain | 206/509 |

(Continued)

FOREIGN PATENT DOCUMENTS

DE 1 531 172 A 12/1969

(Continued)

*Primary Examiner*—Dean J Kramer
(74) *Attorney, Agent, or Firm*—Harness, Dickey & Pierce, P.L.C.

(57) ABSTRACT

A hoisting frame that can be connected at an upper side to hoisting cables and have a device on an underside for picking up a secondary hoisting frame. The hoisting frame may be adjustable between a retracted position, in which its transverse dimension is equal to that of the secondary hoisting frame, and an extended position. Pick-ups are adapted to pick up a single secondary hoisting frame in the retracted position and to pick up two mutually adjacent secondary hoisting frames in the extended position. A method for transferring containers may include picking up one load at a first location when the hoisting frame is retracted, or two loads when the hoisting frame is extended, lifting, displacing to a second location and then lowering the hoisting frame with the picked-up load(s), uncoupling the load(s) from the hoisting frame, lifting the hoisting frame, moving the hoisting frame from one to another position. A secondary hoisting frame may be coupled or uncoupled and the steps repeated.

33 Claims, 17 Drawing Sheets

U.S. PATENT DOCUMENTS

Figure 1:
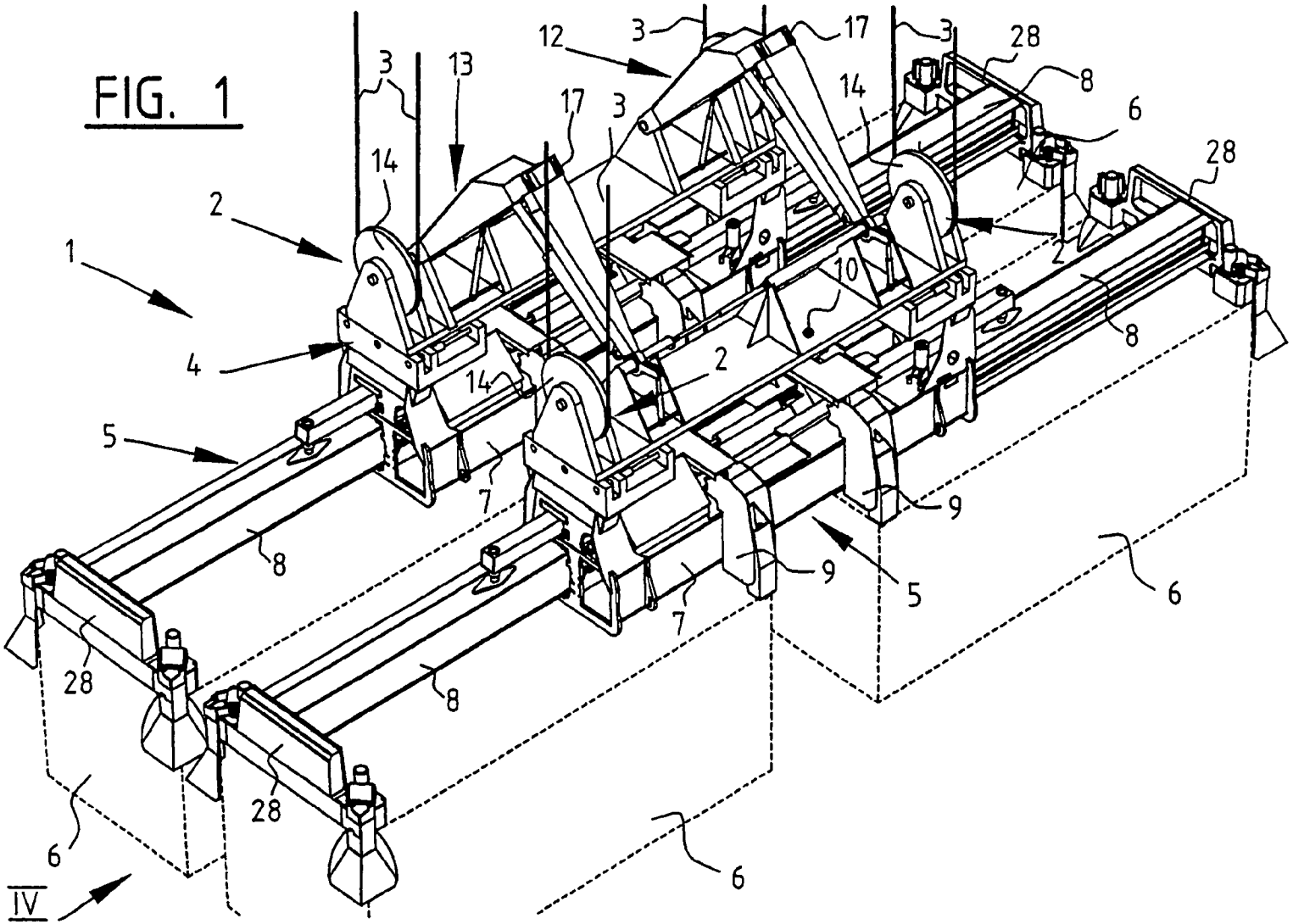

| | | | | |
|---|---|---|---|---|
| 4,244,615 | A | 1/1981 | Brown | |
| 5,163,726 | A * | 11/1992 | Boos et al. | 294/81.1 |
| 5,183,305 | A * | 2/1993 | Nordstrom et al. | 294/81.2 |
| 5,350,210 | A * | 9/1994 | Barnett et al. | 294/81.53 |
| 2003/0189348 | A1 * | 10/2003 | Lindstrom | 294/81.53 |
| 2005/0225104 | A1 * | 10/2005 | Lim et al. | 294/81.1 |

FOREIGN PATENT DOCUMENTS

| | | |
|---|---|---|
| SE | 8 003 408 A | 11/1981 |
| WO | WO 97/39973 | 10/1997 |
| WO | WO 01/98195 A1 | 12/2001 |

* cited by examiner

HOISTING FRAME AND METHOD FOR ITS USE

The invention relates to a hoisting frame, provided with means arranged on the upper side for connecting thereof to at least two hoisting cables suspended at a mutual distance in longitudinal direction of the hoisting frame and means arranged on the underside for picking up at least one secondary hoisting frame. Such a hoisting frame is generally known and is applied particularly for transferring containers from a ship to a quay or vice versa.

Increasingly greater demands are being made on the capacity of hoisting frames for use in the transfer of containers. The use of containers in transport does after all continue to increase, while the price which can be asked for the transport is relatively low as a result of the great competition. The transport of containers must therefore be carried out as efficiently as possible. An important overhead in this respect is the loading and unloading of containers, since a ship lying at quayside is very expensive. Possibilities for increasing the transfer speed are therefore continually being sought. One problem here is that container ships are becoming increasingly larger, both in height and in width. The time involved in hoisting and lowering containers out of and into the hold of the ship and in displacing the containers from the ship to the quay and vice versa therefore continues to increase.

It has therefore already been proposed to pick up a plurality of containers in one movement. Applicant has himself already proposed a hoisting frame with which two containers placed adjacently in longitudinal direction, i.e. with their end surfaces mutually abutting, can be picked up in one movement and the distance between the containers can optionally be adjusted during the trajectory, as described in WO-A-97/39973.

In addition, it is also already known to pick up in one movement two containers mutually abutting on the long side. Use is made for this purpose of a hoisting frame from which are suspended two mutually adjacent sub-frames which can each pick up a container. This known hoisting frame, which is described in WO-A-01/98195, comprises two longitudinal beams which are connected at their ends by two cross beams, from which the sub-frames or secondary hoisting frames are movably suspended. For the movement of the secondary hoisting frames, which can take the form of conventional hoisting frames or "spreaders" adjustable in longitudinal direction, use is made of trolleys which are displaceable along the cross beams and from which the spreaders are suspended via rods or chains. The cross beams of the main frame are each suspended from a hoisting block which has two cable pulleys for co-action with a pair of hoisting cables. In order to compensate for asymmetrical suspending of the hoisting frame as a result of an uneven load, for instance due to a difference in the weight of the two lifted containers, each hoisting block is displaceable in transverse direction along the cross beam under the influence of a hydraulic cylinder or the like.

This known hoisting frame has the drawback that the dimensions thereof must be relatively large in transverse direction in order to enable suspending of both the spreaders thereunder in stable manner. The dimensions in transverse direction are in any case larger than those of a single container or spreader. It is therefore not possible with this known hoisting frame to pick up a single container when this container is not situated in the top layer of containers on a ship. In that case the hoisting frame must be uncoupled from the hoisting blocks and be replaced by a conventional single spreader which can be carried downward between two stacks of containers. The same change is required when the number of containers adjacently of each other in a layer is uneven and a single container is thus finally left standing. Exchanging the hoisting frame and a standard spreader requires a number of extra operations, whereby a part of the time-saving achieved by picking up the containers two at a time is lost. In addition, the hoisting frame takes up very much space when temporarily not in use, which space is scarce and expensive on the quay in the vicinity of the container crane. Feeder and discharge roads to the crane, which heretofore have been designed for the width of a single container, must also be adjusted to the larger width of the hoisting frame.

Another drawback of the known hoisting frame is that during hoisting of containers out of the hold of a ship, wherein as a result of the friction between the guides present therein and the containers varying vertical loads are exerted on the hoisting frame, the hoisting frame will start to swing out of control. In the worst case one of the containers can even become jammed in its guide, whereby the hoisting frame is pulled out of alignment and the hoisting cables will become caught in the pulleys. Because the crane which hauls in the hoisting cables does not come to an immediate stop in the case of such overload, but still has a determined braking distance, there is the chance that the hoisting frame with the containers hereby becomes so jammed that the hoisting frame has to be released from the hoisting blocks and remains behind in the hold.

The invention therefore has for its object to provide a hoisting frame of the above described type, wherein these drawbacks do not occur. This is achieved according to the invention in that the frame is adjustable in transverse direction between a retracted position, in which its transverse dimension is at most equal to that of the secondary hoisting frame, and an extended position in which its transverse dimension is larger than that of the secondary hoisting frame, and the pick-up means are adapted to pick up a single secondary hoisting frame in the retracted position and to pick up two mutually adjacent secondary hoisting frames in the extended position. By giving the frame an adjustable form in transverse direction such that it has a minimal dimension which is smaller than that of a spreader or container, it is suitable for processing single containers as well as two containers simultaneously, wherein single containers can also be processed when they are not positioned in the upper layer.

An effective construction is achieved when the frame is divided in longitudinal direction, the frame parts are movable relative to each other at least in transverse direction and the pick-up means comprise a number of pick-up elements distributed over the frame parts. The desired movements can thus be achieved in simple manner.

The hoisting frame herein preferably has controllable means for moving the frame parts away from and toward each other. These moving means can advantageously comprise at least one member of adjustable length which connects the frame parts, wherein the frame parts can be moved away from or towards each other by adjusting the length of the connecting member.

The moving means further preferably comprise at least one actuator co-acting with the at least one connecting member. The movements can hereby be driven.

A robust and compact construction is obtained when the at least one connecting member is a pivotable arm. A pivoting movement can moreover be driven and controlled in simple manner, and the risk of a pivot becoming jammed is smaller than in the case of a linear movement along a guide. The arm is herein advantageously pivotable substantially parallel to a main plane of the hoisting frame. In this manner the construction height of the hoisting frame remains limited.

In order to reduce the loads on the frame part the at least one pivotable arm can be connected to the frame part via a pivot and the actuator can be arranged between the arm and the pivot. Loads are thus transmitted via the shortest possible route.

In order to enable proper control of the movements of the hoisting frame, this latter preferably has at least two pivotable arms which are each moved by at least one associated actuator. For a precisely determined movement at least two actuators are advantageously connected to at least one of the pivotable arms.

An even distribution of the loads on the hoisting frame is achieved when the pivotable arms are arranged substantially symmetrically relative to a transverse centre line of the hoisting frame, and the arms on opposite sides of the hoisting frame are pivotable in opposite directions.

Likewise with a view to an even distribution of the loads and from production considerations, it is recommended that each pivotable arm is substantially symmetrical relative to a longitudinal centre line of the hoisting frame. Identical arm parts can thus be used.

For a stable movement of the frame parts it is recommended that the connecting means are adapted to connect the hoisting frame to at least two pairs of hoisting cables suspended at a distance from each other in longitudinal direction of the hoisting frame, and are divided in longitudinal direction such that each frame part can be connected to at least two hoisting cables. The connecting means can herein comprise cable pulleys, and each frame part can advantageously carry at least two cable pulleys placed at a distance from each other in longitudinal direction.

For a uniform loading of the hoisting means the pick-up elements are preferably placed substantially straight under the cable pulleys in the extended position of the hoisting frame.

In order to increase the flexibility of the hoisting frame during picking up and setting down of the loads, the frame is advantageously adjustable in transverse direction in the extended position in order to vary a space between the two secondary hoisting frames.

When the frame parts are pivotable relative to each other in the plane of the hoisting frame, loads can also be picked up which are not placed precisely parallel to each other.

In order to allow loads to be picked up or set down on an irregular surface, the frame parts are further preferably pivotable relative to each other transversely of the plane of the hoisting frame. The hoisting frame can herein be provided with at least one actuator arranged between a rotation axis of one of the cable pulleys and the frame part, whereby the pivoting movement can be effected.

The frame parts are further preferably movable relative to each other in longitudinal direction in order to allow picking up of loads which do not lie precisely in one line.

The or each secondary hoisting frame is advantageously also adjustable in longitudinal direction, whereby loads of different length, for instance containers in the sizes 20 feet, 30 feet, 40 feet and 45 feet, can be picked up.

The invention further relates to a method for transferring loads, such as containers, which comprises the steps of:

a) lowering a hoisting frame according to any of the foregoing claims at a first location, b) picking up one load at the first location when the hoisting frame is retracted, or two loads when the hoisting frame is extended, c) lifting the hoisting frame with the picked-up load(s), d) displacing the hoisting frame with the picked-up load(s) to a second location, e) lowering the hoisting frame with the picked-up load(s) at the second location, f) uncoupling the load(s) from the hoisting frame, g) lifting the hoisting frame, h) moving the hoisting frame from its retracted to its extended position or from its extended to its retracted position, wherein a secondary hoisting frame is coupled on or uncoupled, and i) repeating steps (a) to (g).

With such a method it is readily possible to switch from transferring single containers to transferring two containers at a time, and vice versa.

Figure 2:
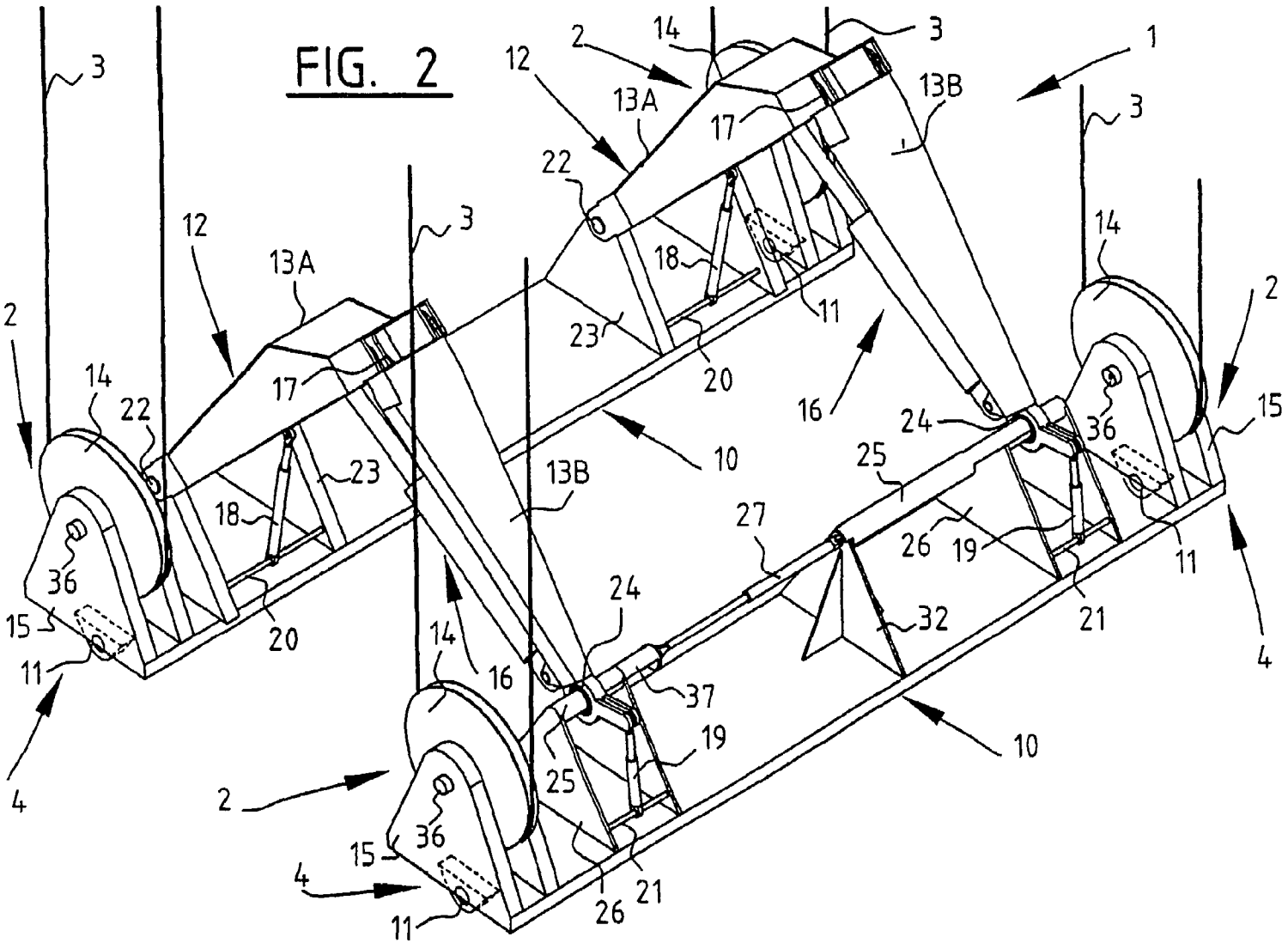
Figure 3:
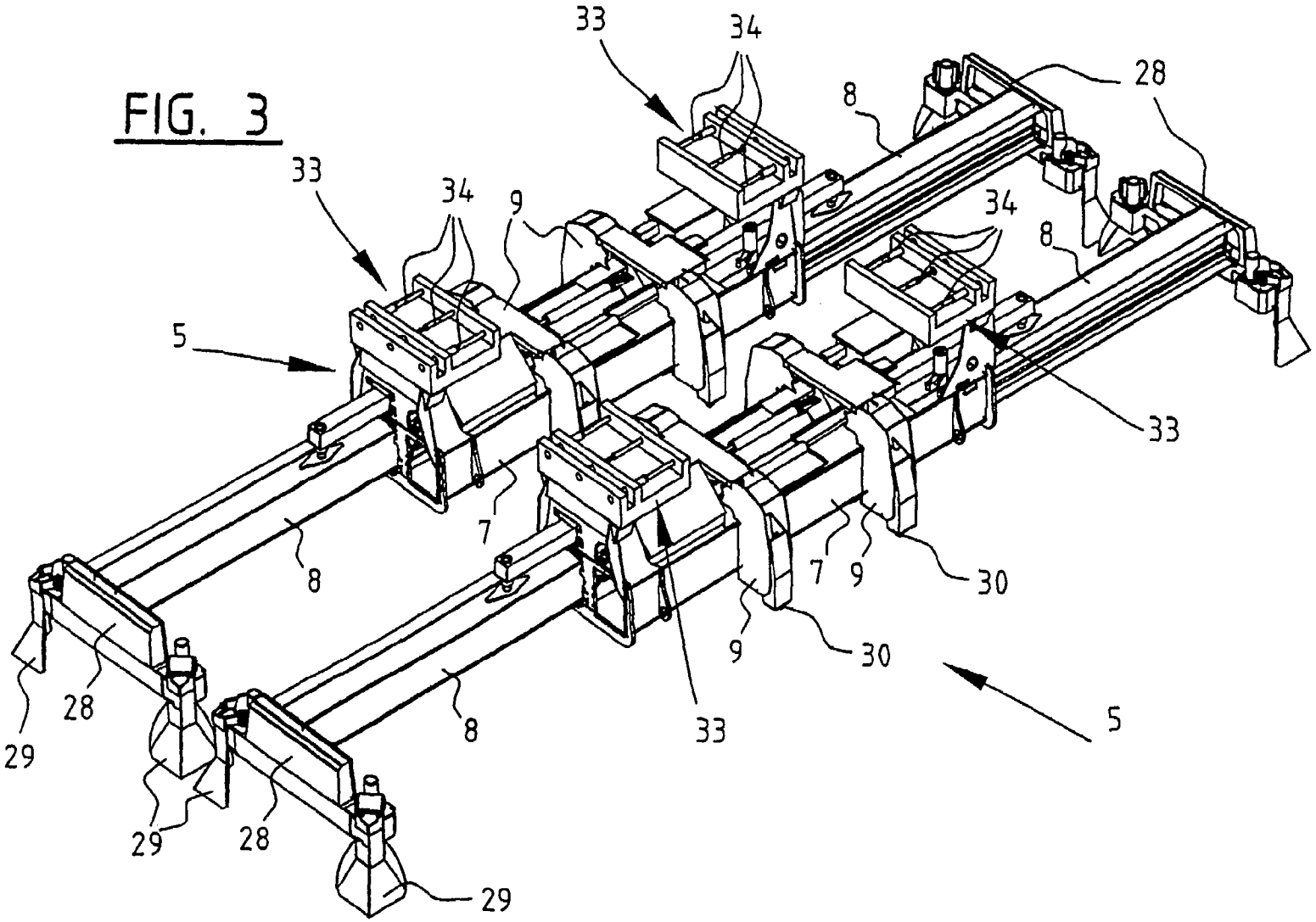
Figure 4A:
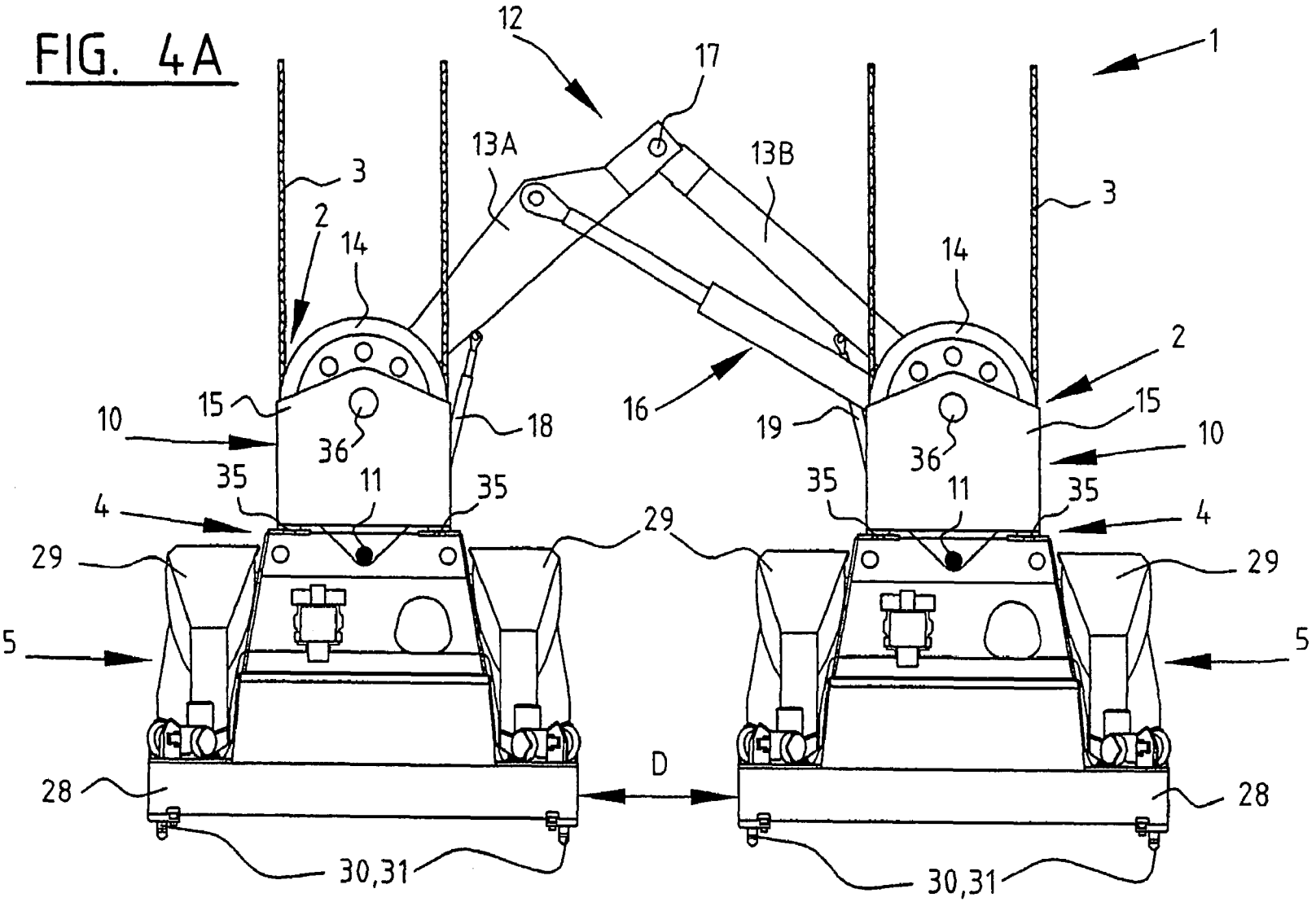
Figure 4B:
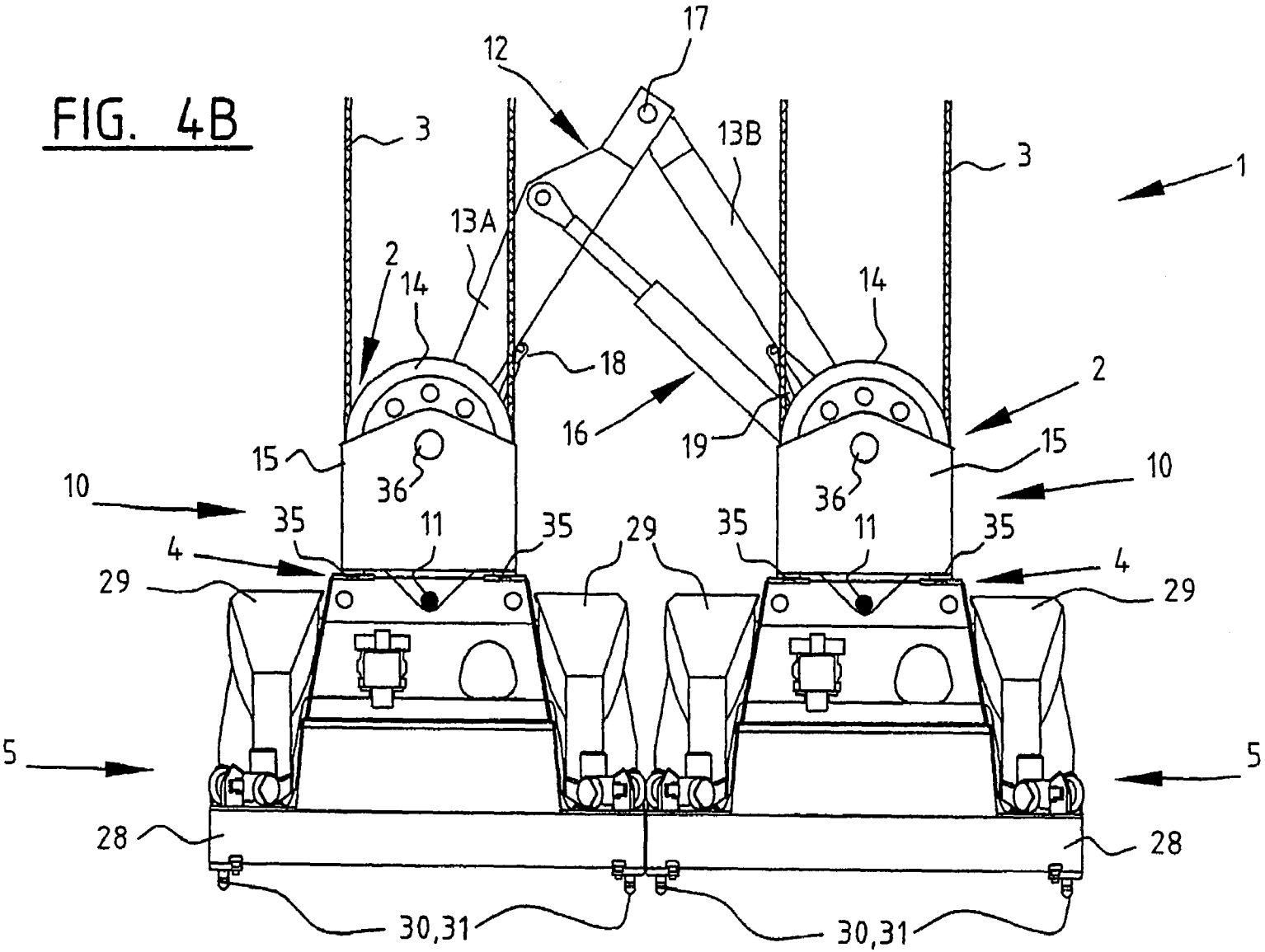
Figure 4C:
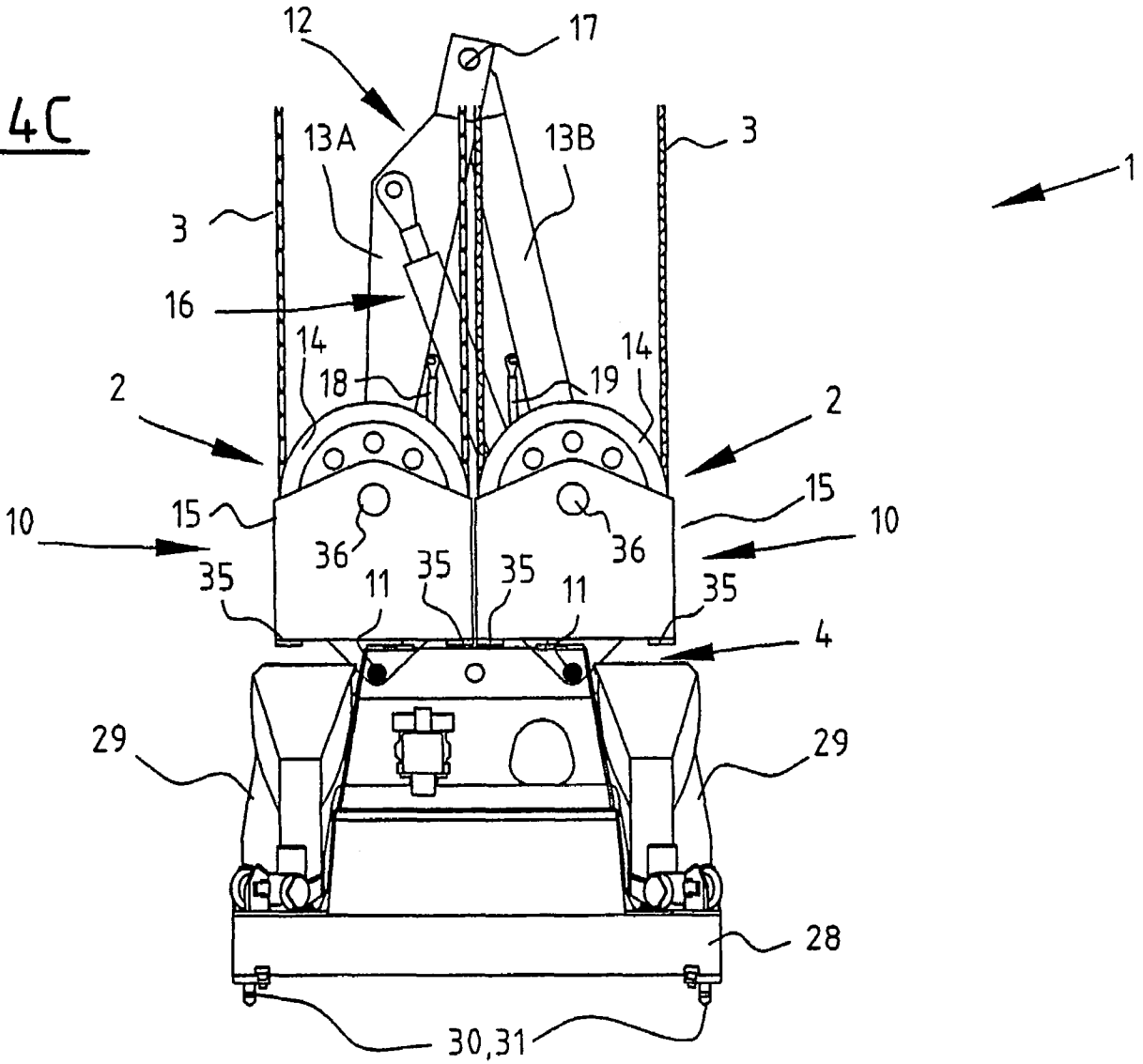
Figure 5A:
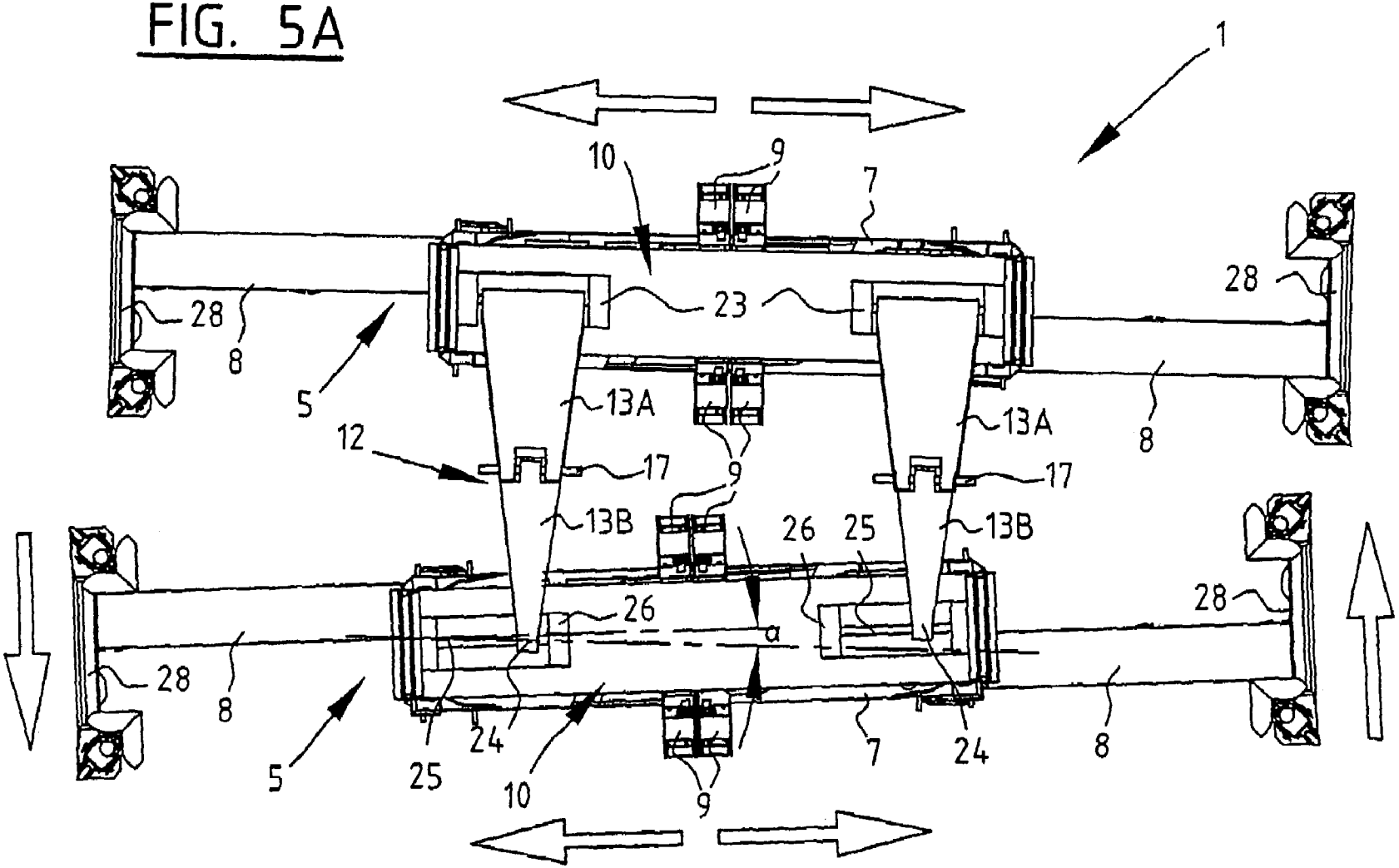
Figure 5B:
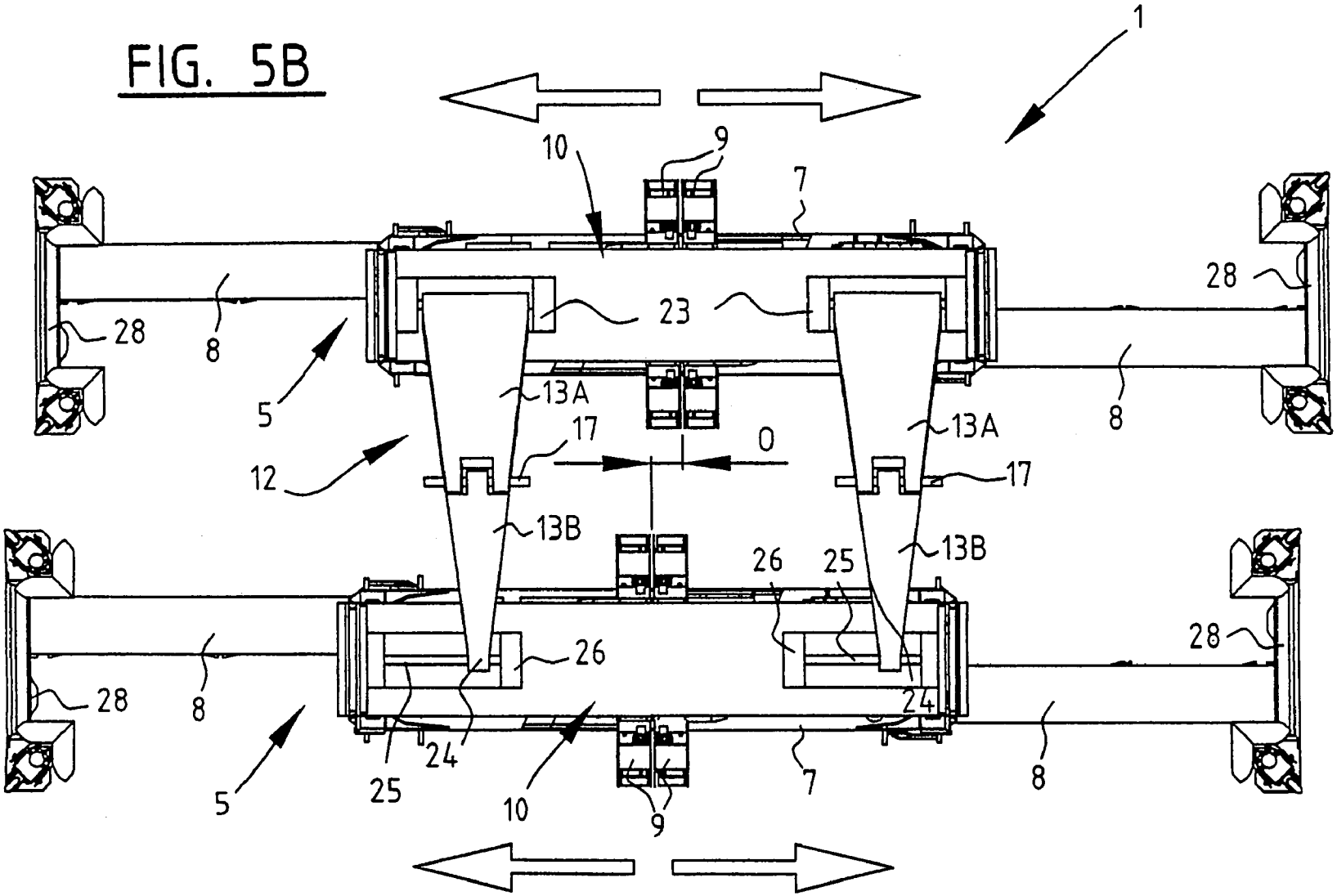
Figure 6:
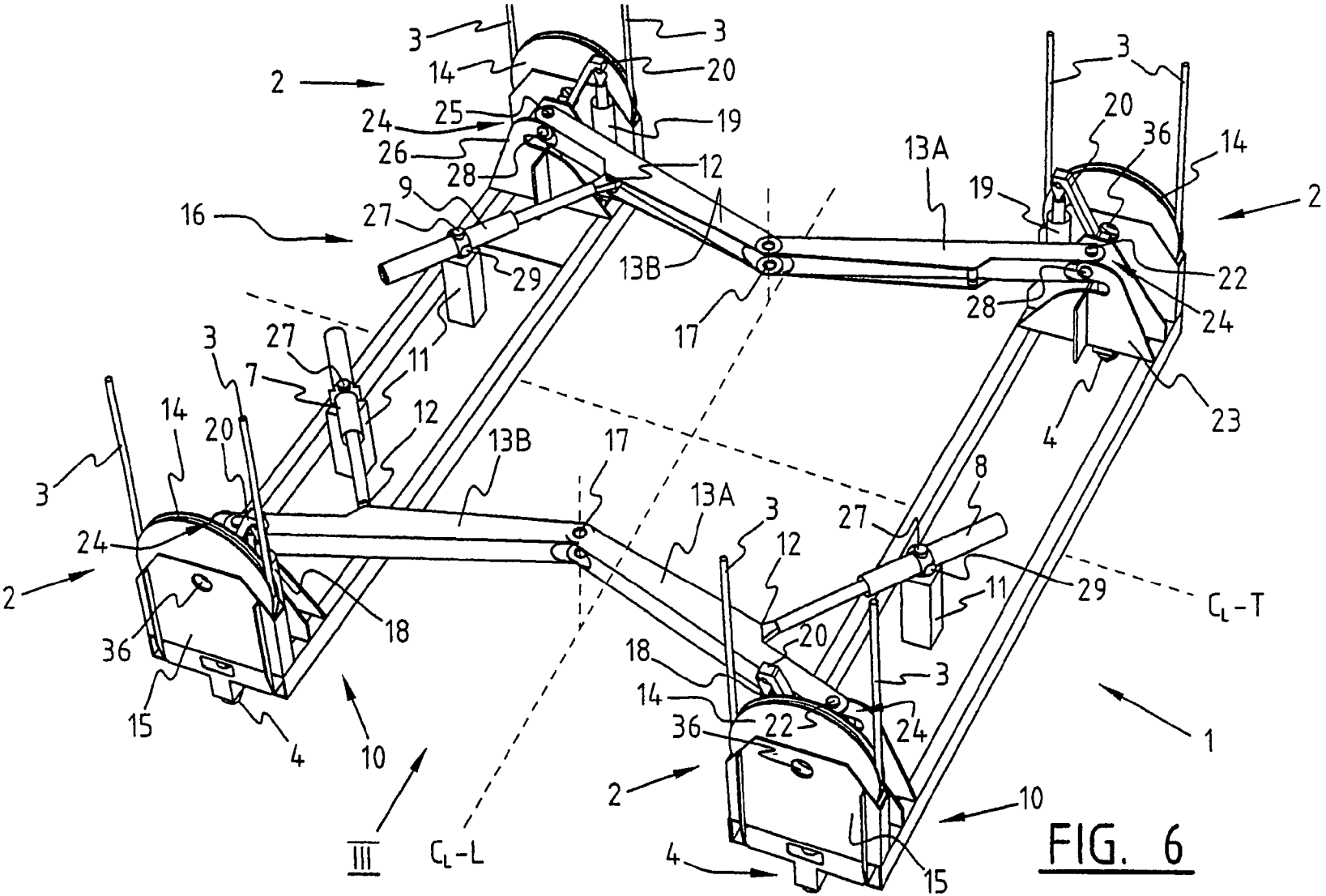
Figure 7A:
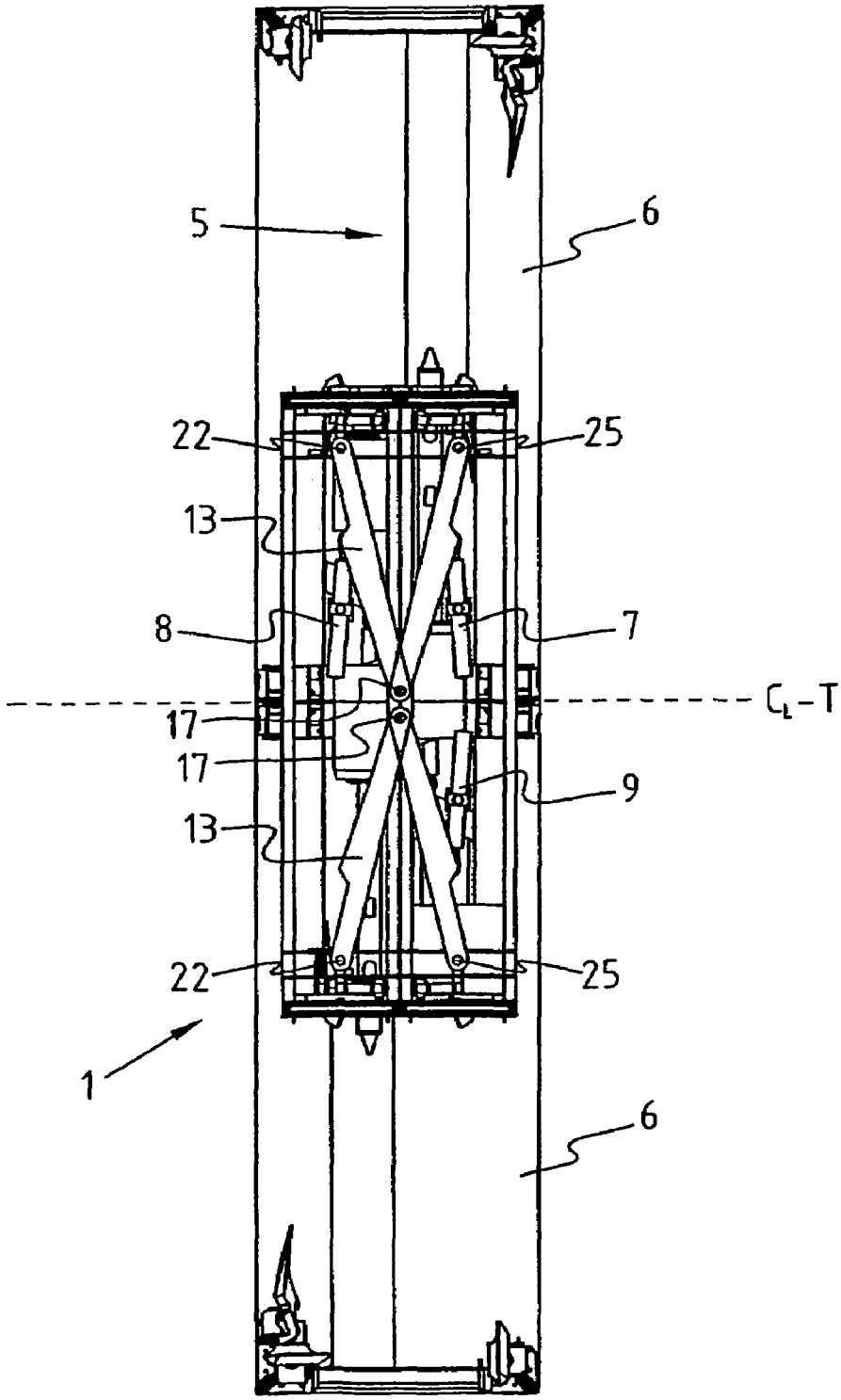
Figure 7B:
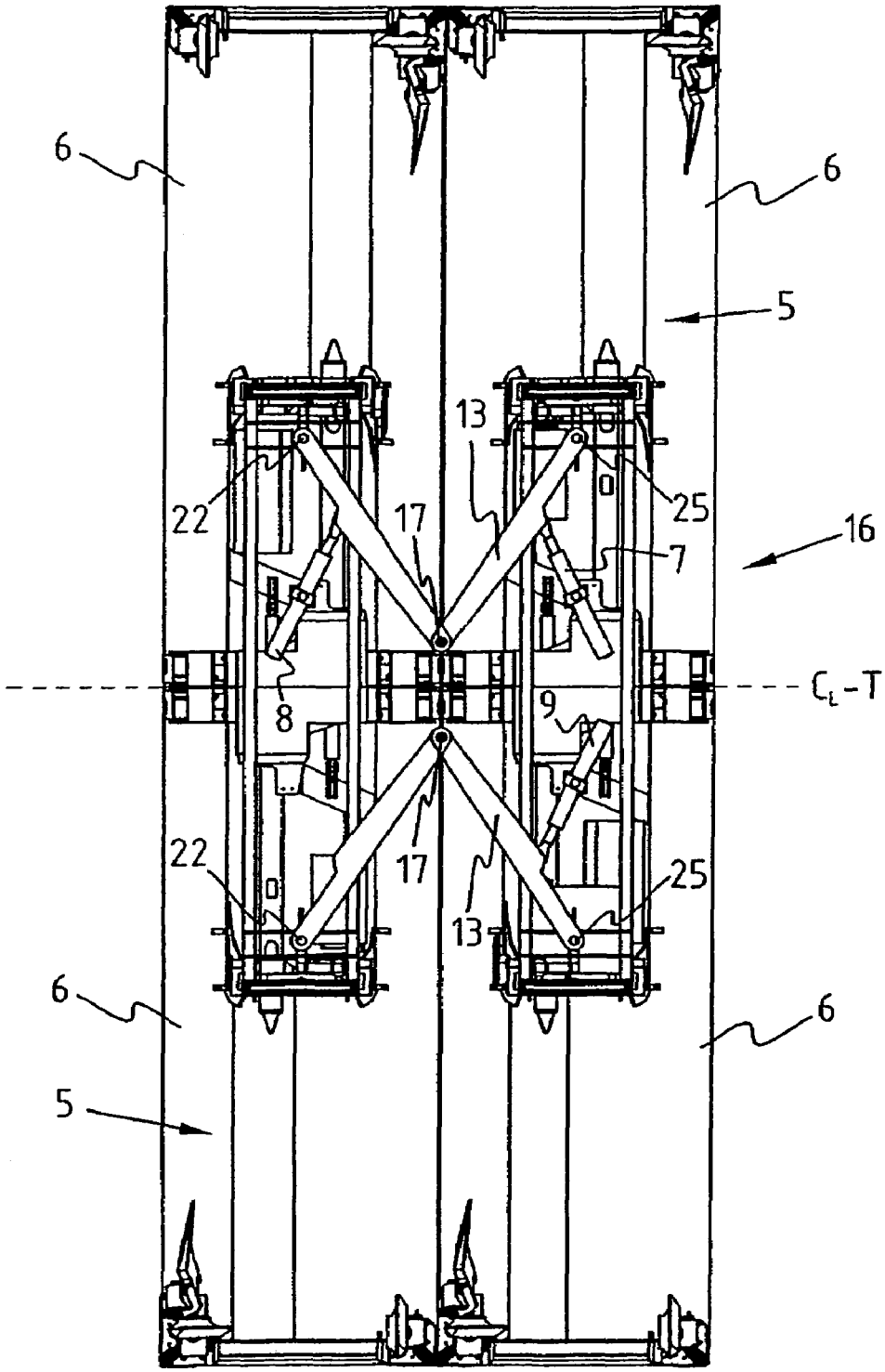
Figure 7C:
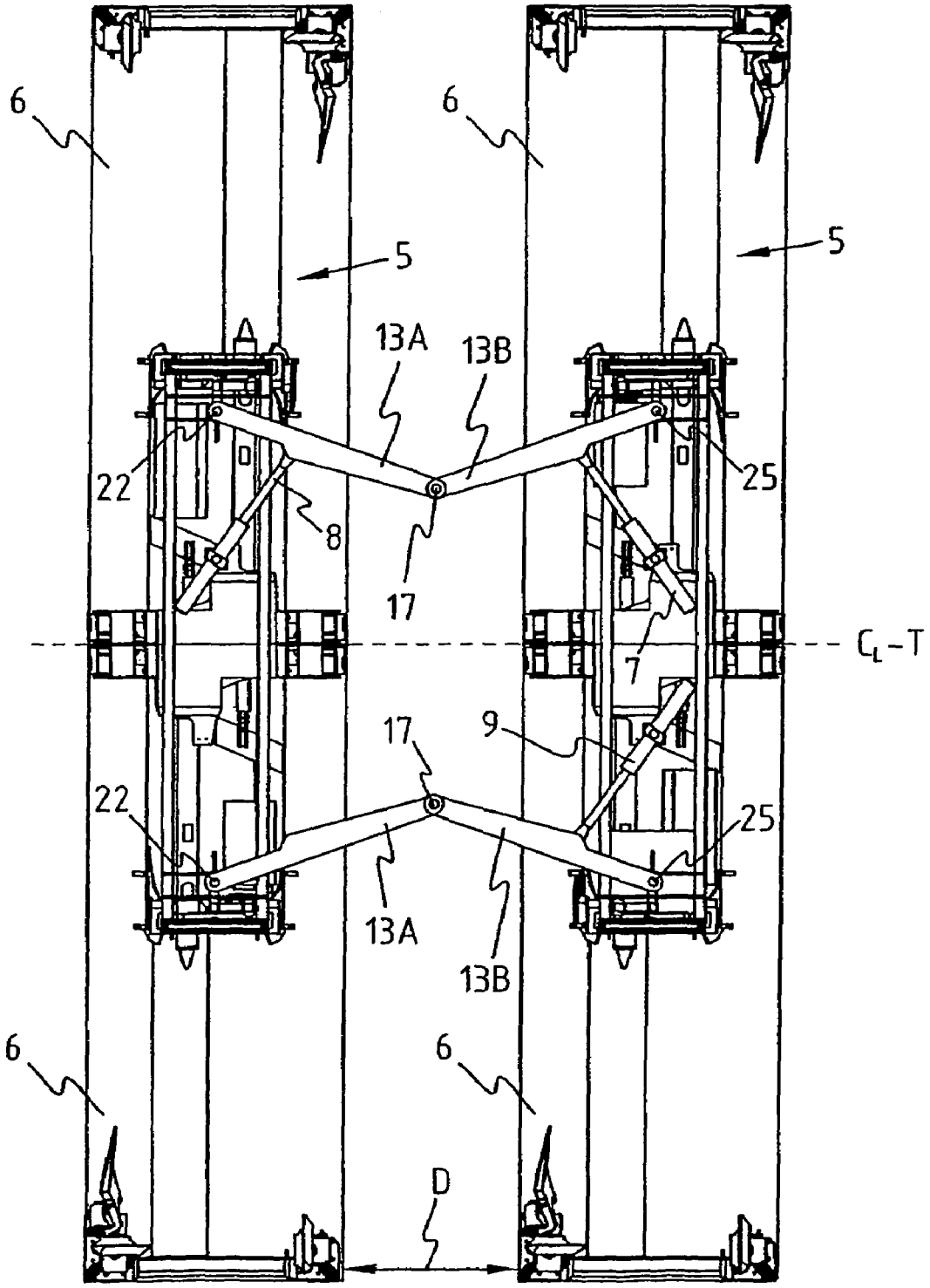
Figure 8C:
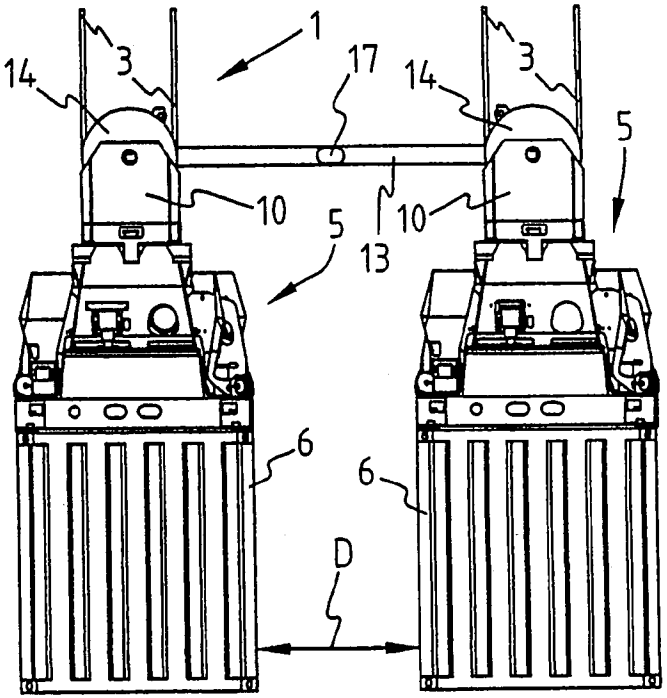
Figure 8B:
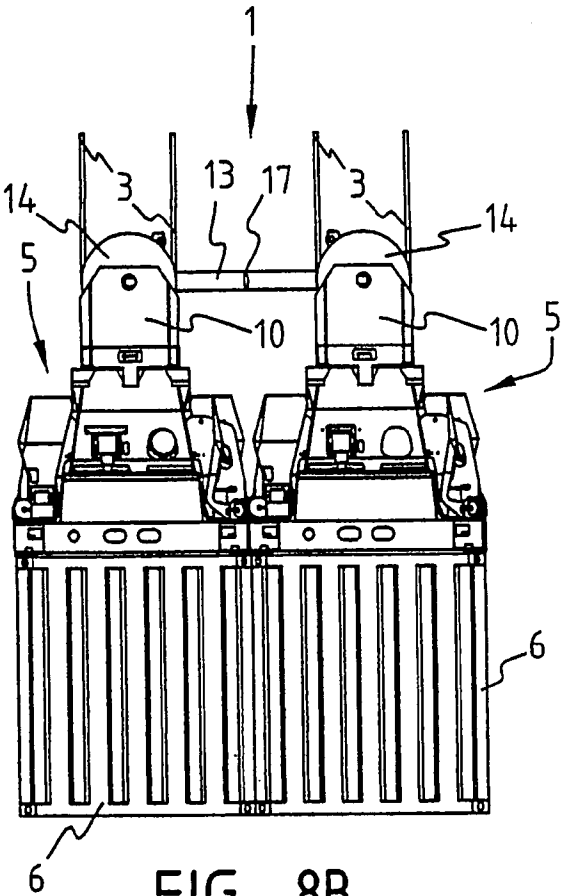
Figure 8A:
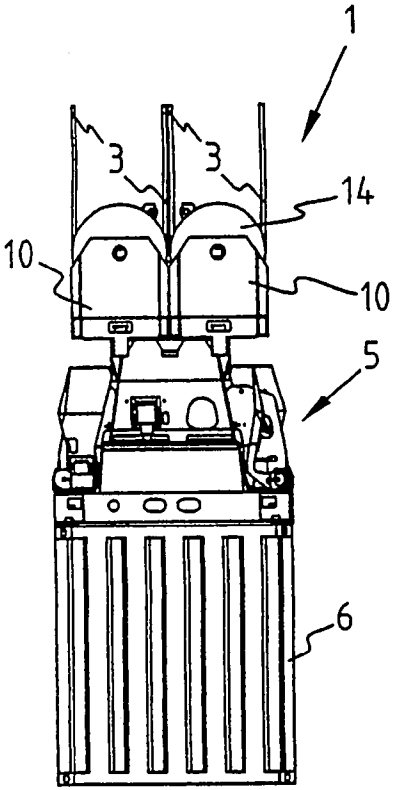
Figure 9:
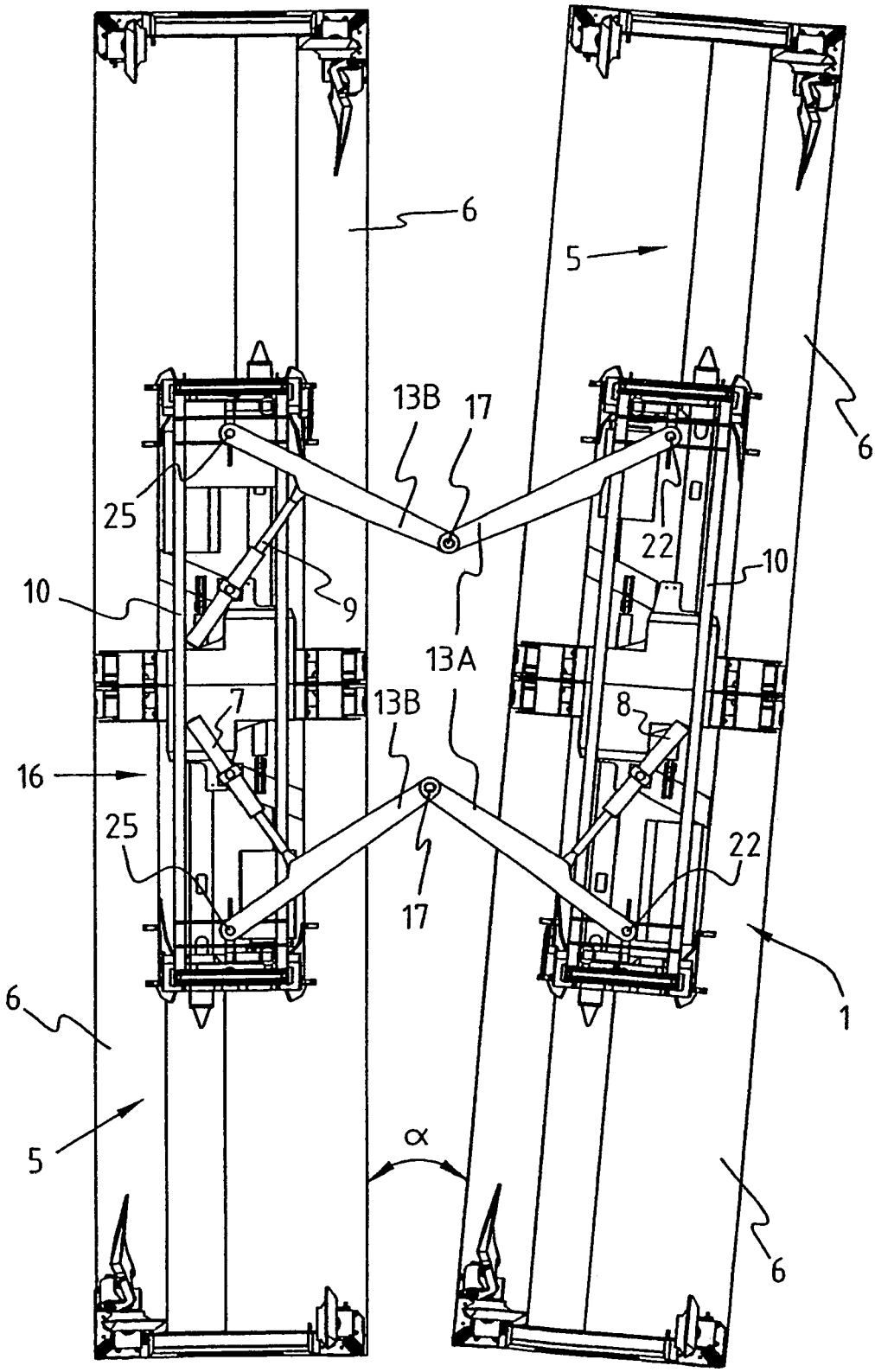
Figure 10:
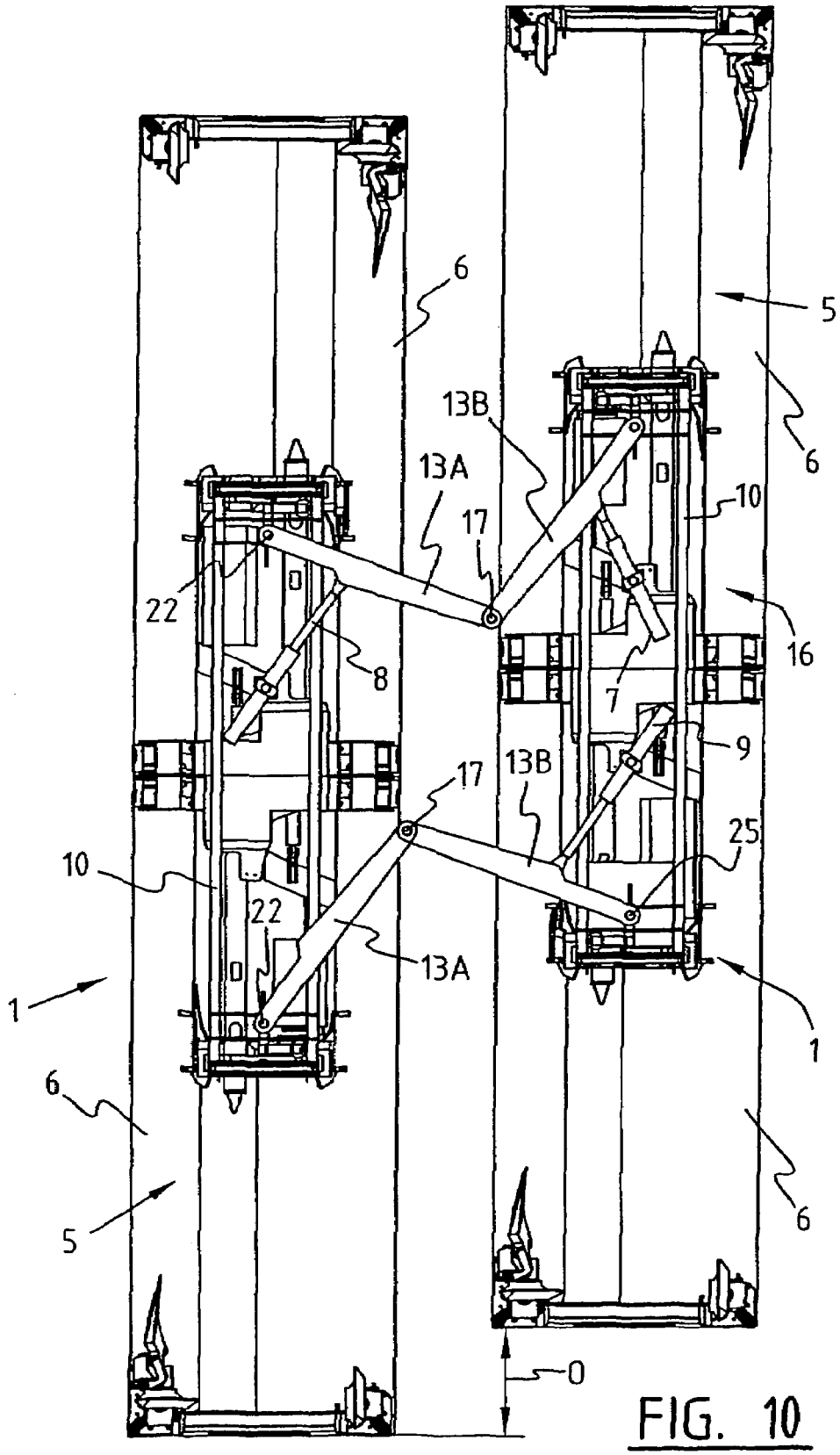
Figure 11:
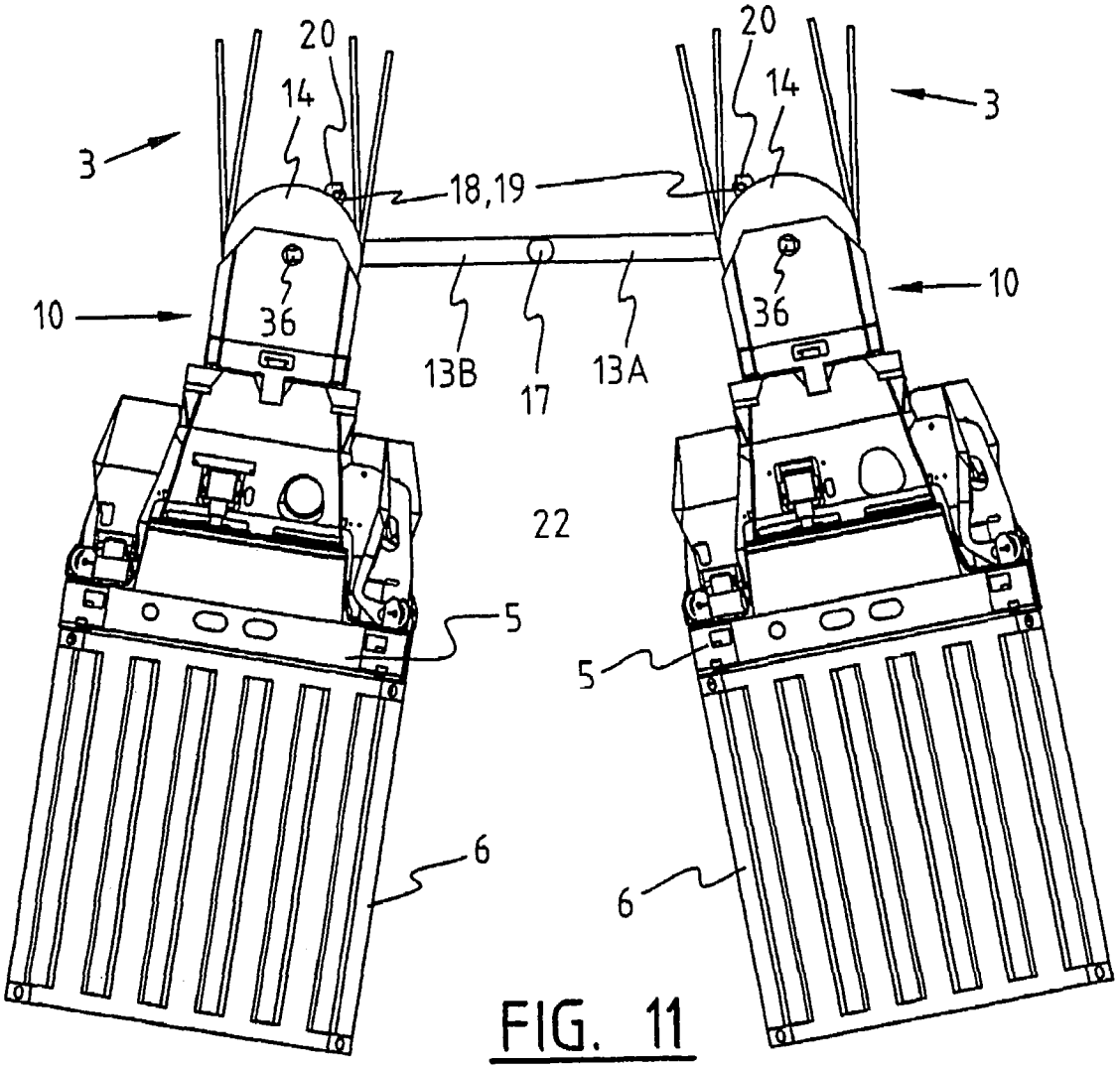
Figure 12:
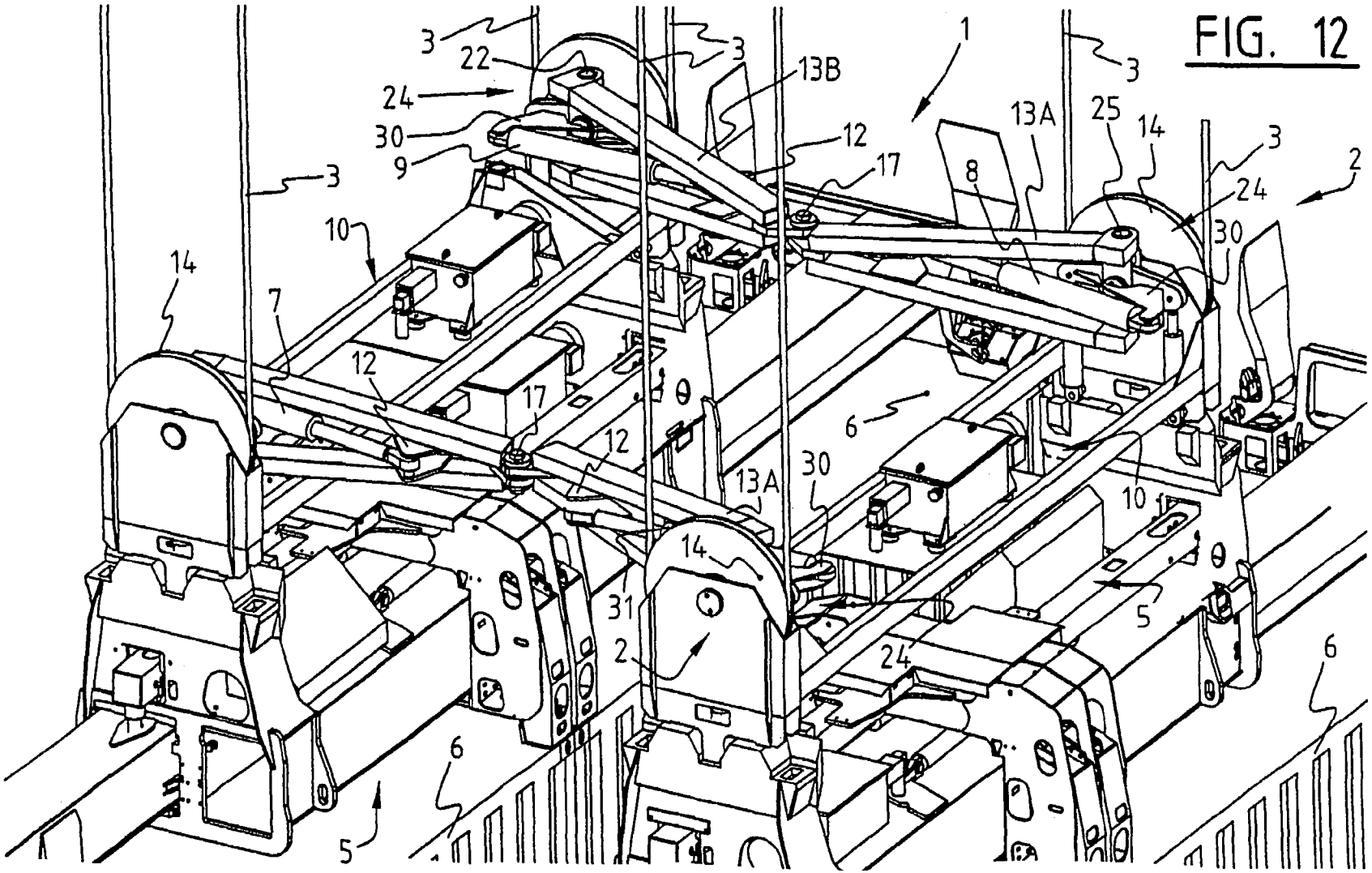

The invention will now be elucidated on the basis of a number of embodiments, wherein reference is made to the annexed drawing, in which:

FIG. 1 is a perspective view of a hoisting frame according to a first embodiment of the invention in the extended position, with two secondary hoisting frames each carrying two containers, FIG. 2 is a perspective view of the hoisting frame according to FIG. 1 in the extended position, FIG. 3 is a perspective view of the two secondary hoisting frames of FIG. 1, FIG. 4A is a front view along arrow IV in FIG. 1 of a hoisting frame according to a second embodiment of the invention in the fully extended position, wherein a space is left clear between two hoisting frames suspended therefrom, FIG. 4B is a view corresponding with FIG. 4A of the hoisting frame in the shortest extended position, wherein the secondary hoisting frames suspended therefrom make mutual contact, FIG. 4C is a view corresponding with FIGS. 4A and 4B of the hoisting frame in its retracted position, wherein only a single hoisting frame is suspended thereunder, FIG. 5A is a top view of the hoisting frame in its extended position, wherein the frame parts and the secondary hoisting frames mounted thereon enclose an angle in the plane of the hoisting frame, FIG. 5B is a view corresponding with FIG. 5A in which the frame parts are shown in a position which is parallel but offset in longitudinal direction, FIG. 6 is a perspective view of a hoisting frame according to a third embodiment of the invention in the extended position, FIG. 7A is a top view of a hoisting frame according to the embodiment shown in FIG. 6 in its retracted position, wherein only a single hoisting frame with two containers is suspended thereunder, FIG. 7B is a view corresponding with FIG. 7A of the hoisting frame in the shortest extended position, wherein the secondary hoisting frames and containers suspended therefrom are in mutual contact, FIG. 7C is a view corresponding with FIGS. 7A and 7B of the hoisting frame in the fully extended position, wherein a space is left clear between two hoisting frames and containers suspended therefrom, FIG. 8A is a front view along VIII in FIG. 6 of the hoisting frame according to the invention with a secondary frame and container(s) thereunder, FIGS. 8B and 8C are views corresponding with FIG. 8A of the hoisting frame with secondary frames and containers in respectively the shortest extended position and the fully extended position, FIG. 9 is a top view of the hoisting frame in its extended position, wherein the frame parts and the secondary hoisting frames and containers mounted thereon enclose an angle in the plane of the hoisting frame, FIG. 10 is a view corresponding with FIG. 9 wherein the frame parts are shown in a position which is parallel but offset in longitudinal direction, FIG. 11 is a front view of the hoisting frame in an extended position, wherein the frame parts are also pivoted transversely of the main plane of the hoisting frame, and FIG. 12 is a view corresponding with FIG. 6 of a fourth embodiment of the hoisting frame according to the invention.

A hoisting frame 1 according to the invention comprises means 2 for connection thereof to two pairs of hoisting cables 3 and means 4 arranged on the underside for picking up one or two secondary hoisting frames or spreaders 5. In the shown embodiment the secondary hoisting frames or spreaders 5 are here so-called "Long Twin"™ spreaders as marketed by applicant and described in WO-A-97/39973. Each spreader 5 comprises in the usual manner a main beam 7, two slide beams 8 and, at the end of each slide beam, a cross beam 28 which carries outer "twist-locks" 31. Arranged on main beam 7 are slidable saddles 9 which carry inner twist-locks 30. Twist-locks 30,31 co-act with openings or "corner castings" on the corners of containers 6 for coupling on or uncoupling of the containers.

Hoisting frame 1 is adjustable in transverse direction between a retracted position (FIG. 4C, 7A, 8A), in which the transverse dimension thereof is at most equal to that of secondary hoisting frame 5 and the container 6 carried thereby, and an extended position (FIG. 4A, 7B, 8B, 4B, 7C, 8C) in which the transverse dimension of frame 1 is larger than that of a spreader 5 or a container 6. The pick-up means 4 on the underside of hoisting frame 1, which are adapted to co-act with corresponding coupling means 33 on the upper side of each spreader 5 (FIG. 3), are embodied and dimensioned such that they can pick up a single spreader 5 in the retracted position of hoisting frame 1, while they co-act with two spreaders 5 in the extended position.

The adjustability in transverse direction of hoisting frame 1 is achieved in the shown embodiment in that the hoisting frame 1 takes a divided form in longitudinal direction and is provided with controllable means 12 for moving frame parts 10 away from and towards each other. In the shown embodiment these moving means 12 comprise two members 13 of adjustable length, here in the form of pivotable arms, which connect the frame parts. Each arm is herein formed by a part 13A which is mounted pivotally via a shaft 22 in a cradle 23 on one of the frame halves 10 and a second part 13B which is connected to the first arm part 13A via a pivot shaft 17. The second arm part 13B is mounted pivotally about a shaft 25 which is supported by a cradle 26 on the other frame half 10. For mounting of this arm part 13B use is made here of a ball joint 24, the purpose of which will be elucidated hereinbelow.

The means 2 for connecting hoisting frame 1 to hoisting cables 3 comprise a number of cable pulleys 14 which are mounted in cradles 15 for rotation about shafts 36. These connecting means 2 herein also take a divided form in the sense that each frame part 10 is provided with two cable pulleys 14 arranged at intervals in longitudinal direction for a stable suspension thereof from hoisting cables 3.

The pick-up means 4 also take a divided form in longitudinal direction and are formed in the shown embodiment by four pick-up elements 11 in the form of eyes protruding on the underside, through which can be placed sliding pins 34 which form part of coupling means 33 of spreaders 5. These pick-up elements 11 are herein placed substantially straight under cable pulleys 14 in order to ensure a stable suspension. A strengthened support part 35 is further formed on either side of each pick-up element 11 in order to enable a moment resulting from an unevenly loaded container 6 to be absorbed.

Moving means 12 further comprise actuators 16 for moving the pivot arms 13, in the shown embodiment in the form of hydraulic cylinders which run practically parallel to arm parts 13B, in order to allow a large stroke without taking up too much space in the retracted position of hoisting frame 1.

In addition to these actuators or drive cylinders 16, damping or stabilizing cylinders 18,19 are also connected to arm parts 13A,13B, which cylinders serve to counter swinging movements of each frame half 10 round a longitudinal axis defined by shafts 36 of cable pulleys 14 when a picked-up container is unevenly loaded or moves unevenly due to friction in the hold of a ship. In addition to a passive damping action, the cylinders 18,19 can also function as actuator and be actively controlled to correct asymmetrical suspension of a frame part 10 as a result of an uneven loading of a container 6. In addition, the invention provides that these actuators 18,19 are actively controlled to pivot each frame part 10 around shafts 36 to a desired angle such that containers 6 can be picked up from or set down on an uneven surface.

These damping cylinders 18,19 are each connected to a slide rod 20,21 on the associated frame half 10, while the ball joints 24, with which the arm parts 13B are mounted around pivot shafts 25, are slidable along these shafts. One of the arm parts 13B is connected via a coupling piece 37 to a cylinder 27 which runs in longitudinal direction and which is fixed to a cradle 32 on the relevant frame half 10.

In the shown embodiment the pivot shafts 22 and pivot shafts 25 are placed substantially in one line with shafts 36 of the cable pulleys so as not to introduce any additional moments around these shafts 36 during a movement of frame parts 10.

The above described arrangement of the pivot arms, the drive mechanism and the bearing enables a large number of movements of frame parts 10 relative to each other, both parallel to the plane of hoisting frame 1 and transversely thereof. When drive cylinders 16 are moved synchronously, frame halves 10 are in principle moved apart in transverse direction and parallel to each other. Frame parts 10 can thus be moved from the retracted to the extended position, but they can also be moved further apart from the extended position in order to form or to vary an intermediate space D between two lifted containers 6.

If one of the two drive cylinders 16 is extended or retracted less far than the other and the cylinder 27 running in longitudinal direction is operated simultaneously, non-parallel movements of the two frame parts 10 are then possible. Frame parts 10 can for instance then be placed in the plane of frame 1 at an angle ∀ relative to each other (FIG. 5A), whereby containers 6 which do not stand parallel to each other can be picked up. It is also possible for frame halves 10 to be placed at an angle relative to each other transversely of the plane of the hoisting frame to allow containers 6 to be picked up which are not in wholly horizontal position.

Finally, when drive cylinders 16 are moved synchronously but in addition the longitudinal cylinder 27 is also operated, it is possible to move the frame parts 10 in longitudinal direction relative to each other when containers must be picked up which are offset relative to each other over a distance "O" (FIG. 5B).

In an alternative embodiment of hoisting frame 1 (FIG. 6), shafts 17, 22 and 25 are positioned substantially transversely of a main plane of hoisting frame 1 and thus run roughly parallel to hoisting cables 3. Arms 13 can therefore pivot substantially parallel to hoisting frame 1 and transversely of hoisting cables 3. Arms 13 hereby take up relatively little space above hoisting frame 1. This is important because container ships are loaded increasingly higher but container cranes have a limited height, whereby the space between the crane jib and the ship is becoming increasingly smaller. Furthermore, the arms 13 thus lie close to the centre of gravity of frame 1. The arms 13 on either side of frame 1 are also arranged symmetrically relative to a transverse centre line $C_L$-T of frame 1 and pivot in opposite directions, whereby an even distribution of the loads over hoisting frame 1 is achieved.

In the shown embodiment the arms 13 are also symmetrical relative to a longitudinal centre line $C_L$-L of frame 1, and arm parts 13A,13B are identical.

For the mounting of arm parts 13A,13B use is once again made of pivots 24 with a certain degree of flexibility in height direction. Pivots 17 of arm 13 can also display such a flexibility in height direction, so that movements transversely of the main plane of the hoisting frame are possible.

In this embodiment the actuators 7,8,9 by which the arms 13 are moved lie in the plane of these arms 13. Actuators 7,8,9 are connected to one of the frame parts 10 for movement with one end round vertical pivot shaft 27 via an elevation 11, while the other end of each actuator 7,8,9 is connected to a point of engagement 12 roughly halfway along an arm part 13A,13B which can be operated thereby. The pivot connection 27 between each actuator 7,8,9 and the associated elevation 11 is also slightly flexible in height direction so as to allow actuators 7,8,9 to follow the movements of arms 13.

Pivots 17 and 24 of arms 13 and pivots 27 of actuators 7,8,9 can again be embodied as ball joints. A more robust construction is however achieved when in any case the pivots 24,27 take the form of universal joints with, in addition to the main pivot shaft 22,26 respectively 27, a secondary pivot shaft 28 respectively 29 lying transversely thereof.

In this embodiment the actuators 18,19 are each also connected at one end to a rod 20 which is fixed non-rotatably to a corresponding shaft 36, while the other end of actuator 18,19 engages on frame part 10.

All actuators 7,8,9,18,19 are embodied in the shown embodiment as hydraulic piston/cylinder units which can exert a relatively great force at relatively small dimensions, and which can furthermore be operated and fed from great distance in simple manner by means of hydraulic lines.

When in this embodiment the three actuators 7,8,9 are moved synchronously, pivot arms 13 will be extended or folded up to the same extent and frame halves 10 are thus moved away from or toward each other mutually parallel in transverse direction.

If the actuators 7,8 connected to one of the two pivot arms 13 are extended or retracted less far than the actuator 9 connected to the other arm 13, non-parallel movements of the two frame parts 10 are then possible.

Finally, when actuators 8,9 are moved synchronously and actuator 7 is simultaneously operated in the opposite direction, it is possible to move the frame parts 10 in longitudinal direction relative to each other.

In addition to the described movements in the plane of hoisting frame 1, limited movements transversely of this plane are also possible as a consequence of the flexibility in pivots 17,24,27 in height direction. By extending or retracting the actuators 18,19 the frame halves 10 can thus be placed at an angle relative to each other transversely of the plane of the hoisting frame, so as to be able to pick up containers 6 which are not in wholly horizontal position. Pivoting movements are not only possible here round the longitudinal centre line $C_L$-L, but also round the transverse centre line $C_L$-T.

In yet another embodiment of hoisting frame 1 (FIG. 12) there are four actuators 7,8,9,31, two for each arm 13. Actuators 7,8,9,31 are herein not mounted directly on a frame part 10 but mounted with one end on a protruding part 30 of the pivot 24, embodied as universal joint, of the arm part 13A, 13B controlled thereby. Each actuator 7,8,9,31 hereby automatically follows the (slight) movements in height direction of the associated arm part 13A,13B without having to be individually mounted for movement in height direction. In addition, the force exerted by each actuator 7,8,9,31 does not therefore have to be transmitted to arm 13 via frame part 10 and pivot 24, but is transmitted directly to the arm, whereby the construction of frame part 10 can be lighter and simpler.

With the hoisting frame 1 according to the invention at least two containers at a time placed with their long side adjacently of each other can thus be picked up, moved upward, displaced and set down again simultaneously in simple, rapid and reliable manner. The transfer capacity of a crane provided with such a hoisting frame is hereby practically doubled.

However, in order to also allow use of the hoisting frame to lift single containers when they are not situated in the uppermost layer of containers, the hoisting frame 1 can be readily returned from its extended position to its retracted position. For this purpose one of the spreaders 5 is first uncoupled from the frame half 10 from which it is suspended by means of connecting pin 11, and set down somewhere it does not hinder the further hoisting operations. A place will often be reserved in the vicinity of the container crane, or on the frame thereof, for storage of a spreader, since a standby spreader generally also has to be available when normal, single spreaders are being used.

After one of the spreaders 5 has thus been uncoupled in this manner, the other spreader 5 is also temporarily uncoupled and set down, whereupon the frame halves 10 are moved toward each other by activating the cylinders 16. Hoisting frame 1 is herein also displaced slightly in transverse direction in order to place the pick-up eyes 11 into register with outer coupling pins 34 of the single remaining spreader 5. After a coupling has then been realized, hoisting frame 1 can be used to pick up single containers. Various aspects are shown in FIGS. 4A to 4C, in which a slightly modified embodiment of the hoisting frame is shown, with differently formed bearing cradles 15 and differently placed damping and stabilizing cylinders 18,19.

Although the invention is described above on the basis of an embodiment, it will be apparent that it is not limited thereto. Instead of a frame consisting of two parts which are displaceable relative to each other in transverse direction, use could thus also be made of a frame having pick-up means placed on telescopic arms, whereby a spreader construction acting in transverse direction is in fact obtained.

Instead of the shown pivot arms, other moving mechanisms such as telescopic arms or horizontal shear constructions could also be envisaged. Combinations of for instance one vertical pivot arm and a horizontal telescope are also conceivable.

It is of course of no importance for the invention which type of spreader is suspended under the hoisting frame. In addition to the shown "Long Twin"™ spreader, a normal spreader adjustable in longitudinal direction or even a fixed frame with twist-locks could also be arranged.

The connection between the hoisting frame and the spreaders can further be embodied in many different ways. In addition to the shown sliding pins and eyes, twist-lock connections can for instance also be envisaged. A plurality of pick-up eyes could also be arranged, whereby each spreader would be picked up at two points lying at a distance from each other in transverse direction, even when the hoisting frame is used in the extended position with two spreaders.

Finally, it is of course also possible to extend the inventive concept from two to three or more spreaders, wherein one hoisting frame could be suitable for picking up two spreaders in a retracted position and three spreaders in an extended position, or could even be varied between positions in which one, two or three spreaders are picked up.

The scope of the invention is therefore defined solely by the appended claims.

The invention claimed is:

1. Hoisting frame for transferring containers, the hoisting frame comprising:

means, arranged on an upper side of the frame, for connecting the frame to at least two hoisting cables suspended at a mutual distance in a longitudinal direction of the hoisting frame; and means, arranged on an underside of the frame, for picking up at least one secondary hoisting frame, which secondary hoisting frame has twist-locks for picking up at least one container, a transverse dimension of the secondary hoisting frame corresponding substantially with a transverse dimension of a container, wherein the frame is adjustable in a transverse direction between a retracted position, in which a transverse dimension of the frame is at most equal to that of the secondary hoisting frame and the container, and an extended position in which the transverse dimension is larger than that of the secondary hoisting frame, the frame being divided in the longitudinal direction into frame parts that are movable relative to each other at least in a transverse direction, and wherein the means for picking up are for picking up a single secondary hoisting frame in the retracted position and for picking up two mutually adjacent secondary hoisting frames in the extended position, the means for picking up including a plurality of pick-up elements distributed on the frame parts and the pick-up elements on one of the frame parts cooperating with the pick-up elements on another one of the frame parts for picking up the single secondary hoisting frame when the frame parts are moved toward each other to the retracted position of the frame.

2. Hoisting frame as claimed in claim 1, further comprising:

controllable means for moving the frame parts away from and toward each other.

3. Hoisting frame as claimed in claim 2, wherein the controllable means includes at least one member of adjustable length which connects the frame parts.

4. Hoisting frame as claimed in claim 3, wherein the controllable means includes at least one actuator co-acting with the at least one connecting member.

5. Hoisting frame as claimed in claim 4, wherein at least one pivotable arm is connected to the frame part via a pivot, and the actuator is arranged between the arm and the pivot.

6. Hoisting frame as claimed in claim 4, wherein the at least one connecting member is a pivotable arm.

7. Hoisting frame as claimed in claim 3, wherein the at least one connecting member is a pivotable arm.

8. Hoisting frame as claimed in claim 7, wherein the arm is pivotable substantially parallel to a main plane of the hoisting frame.

9. Hoisting frame as claimed in claim 8, wherein the at least one pivotable arm is connected to the frame part via a pivot, and the actuator is arranged between the arm and the pivot.

10. Hoisting frame as claimed in claim 7, wherein at least two pivotable arms are included, each moveable by at least one associated actuator.

11. Hoisting frame as claimed in claim 10, wherein at least two actuators are connected to at least one of the pivotable arms.

12. Hoisting frame as claimed in claim 11, wherein the pivotable arms are arranged substantially symmetrically relative to a transverse centre line of the hoisting frame, and wherein the arms on opposite sides of the hoisting frame are pivotable in opposite directions.

13. Hoisting frame as claimed in claim 10, wherein the pivotable arms are arranged substantially symmetrically relative to a transverse centre line of the hoisting frame, and wherein the arms on opposite sides of the hoisting frame are pivotable in opposite directions.

14. Hoisting frame as claimed in claim 7, wherein each pivotable arm is substantially symmetrical relative to a longitudinal centre line of the hoisting frame.

15. Hoisting frame as claimed in claim 7, wherein the at least one pivotable arm is connected to the frame part via a pivot, and the actuator is arranged between the arm and the pivot.

16. Hoisting frame as claimed in claim 1, wherein the connecting means are for connecting the hoisting frame to at least two pairs of hoisting cables suspended at a distance from each other in the longitudinal direction of the hoisting frame, and are divided in the longitudinal direction such that each frame part is connectable to at least two hoisting cables.

17. Hoisting frame as claimed in claim 16, wherein the connecting means includes cable pulleys, and wherein each frame part carries at least two cable pulleys placed at a distance from each other in longitudinal direction.

18. Hoisting frame as claimed in claim 17, wherein the pick-up elements are placed substantially straight under the cable pulleys in the extended position of the hoisting frame.

19. Hoisting frame as claimed in claim 17, further comprising at least one actuator arranged between the rotation axis of one of the cable pulleys and the frame part.

20. Hoisting frame as claimed in claim 1, wherein the extended position the frame is adjustable in the transverse direction in order to vary a space between the two secondary hoisting frames.

21. Hoisting frame as claimed in claim 1, wherein the frame parts are pivotable relative to each other in the plane of the hoisting frame.

22. Hoisting frame as claimed in claim 1, wherein the frame parts are pivotable relative to each other transversely of the plane of the hoisting frame.

23. Hoisting frame as claimed in claim 22, further comprising at least one actuator arranged between the rotation axis of one of the cable pulleys and the frame part.

24. Hoisting frame as claimed in claim 1, wherein the frame parts are movable relative to each other in the longitudinal direction.

25. Hoisting frame as claimed in claim 1, wherein the secondary hoisting frame is adjustable in the longitudinal direction.

26. Method for transferring loads, comprising the steps of:

a) lowering a hoisting frame as claimed in claim 1 at a first location, b) picking up one load at the first location when the hoisting frame is retracted, or two loads when the hoisting frame is extended, c) lifting the hoisting frame with the picked-up at least one load, d) displacing the hoisting frame with the picked-up at least one load to a second location, e) lowering the hoisting frame with the picked-up at least one load at the second location, f) uncoupling the at least one load from the hoisting frame, g) lifting the hoisting frame, h) moving the hoisting frame from its retracted to its extended position or from its extended to its retracted position, wherein a secondary hoisting frame is coupled on or uncoupled, and i) repeating steps (a) to (g).

27. Method as claimed in claim 26, wherein the method is for transferring containers.

28. Combination of a primary hoisting frame and at least one secondary hoisting frame, wherein the primary hoisting frame comprises:

means, arranged on an upper side of the frame, for connecting the frame to at least two hoisting cables suspended at a mutual distance in a longitudinal direction of the hoisting frame; and means arranged on an underside of the frame, for picking up the at least one secondary hoisting frame; and wherein the at least one secondary hoisting frame comprises twist-locks for picking up at least one container, the at least one secondary hoisting frame having a transverse dimension that is substantially equal to a transverse dimension of the at least one container;

wherein the primary hosting frame is adjustable in a transverse direction between a retracted position, in which a transverse dimension of the frame is at most equal to that of the at least one secondary hoisting frame and the least one container, and an extended position in which the transverse dimension is larger than that of the at least one secondary hoisting frame, and wherein the means for picking up are for picking up a single secondary hoisting frame in the retracted position and for picking up two mutually adjacent secondary hoisting frames in the extended position.

29. Combination as claimed in claim 28, wherein the primary hoisting frame is divided in the longitudinal direction into the frame parts that are movable relative to each other at least in the transverse direction and the means for picking up includes a number of pick-up elements distributed over the frame parts.

30. Combination as claimed in claim 29, further comprising:

controllable means for moving the frame parts from and toward each other.

31. Combination as claimed in claim 30, wherein the controllable means includes at least one member of adjustable length which connects the frame parts.

32. Combination as claimed in claim 31, wherein the controllable means includes at least one actuator co-acting with the at least one connecting member.

33. Combination as claimed in claim 32, wherein the at least one connecting member is a pivotable arm.

* * * * *